United States Patent [19]

Thompson

[11] Patent Number: 4,756,534

[45] Date of Patent: Jul. 12, 1988

[54] GOLF CLUB

[76] Inventor: Stanley C. Thompson, 7851 Talbert St., Apt. 1, Plava del Rey, Calif. 90271

[21] Appl. No.: 929,099

[22] Filed: Nov. 10, 1986

Related U.S. Application Data

[63] Continuation of Ser. No. 691,504, Jan. 14, 1985, abandoned.

[51] Int. Cl.[4] ..... A63B 53/04

[52] U.S. Cl. ..... 273/171; 273/172; 273/167 H

[58] Field of Search ..... 273/172, 174, 167 A, 273/167 D, 167 F, 167 J, 174

[56] References Cited

U.S. PATENT DOCUMENTS

| | | | |
|---|---|---|---|
| 1,000,982 | 8/1911 | Biddle | 273/174 |
| 3,761,095 | 9/1973 | Thompson | 273/174 |
| 3,845,960 | 11/1974 | Thompson | 273/171 |
| 3,873,090 | 3/1975 | Thompson | 273/80.8 |
| 3,961,796 | 6/1976 | Thompson | 273/167 A |
| 4,162,794 | 7/1979 | Thompson | 273/174 |
| 4,180,269 | 12/1979 | Thompson | 273/171 |
| 4,313,607 | 2/1982 | Thompson | 273/167 H |
| 4,319,752 | 3/1982 | Thompson | 273/171 |
| 4,325,550 | 4/1982 | Thompson et al. | 273/80 C |
| 4,332,388 | 6/1982 | Crow | 273/172 |
| 4,498,673 | 2/1985 | Swanson | 273/174 |

FOREIGN PATENT DOCUMENTS

| | | | |
|---|---|---|---|
| 517798 | 9/1978 | Australia | 273/167 A |
| 522398 | 9/1978 | Australia | 273/167 A |
| 1103714 | 6/1981 | Canada | 273/167 A |
| 452389 | 8/1936 | United Kingdom | 273/172 |
| 2009602 | 12/1978 | United Kingdom | 273/167 A |
| 2081106 | 7/1981 | United Kingdom | 273/167 A |

*Primary Examiner*—George J. Mario
*Attorney, Agent, or Firm*—William W. Haefliger

[57] ABSTRACT

A golf club head has a front face, bottom and top surfaces, and a keel extending generally forwardly at the bottom of the head. The keel has a forwardmost surface sloping upwardly and forwardly from the bottom of the keel, to intersect the front face at a lateral linear location substantially above the bottom level of the keel, whereby the keel sloping surface on striking the ground during a golf swing will transfer some force upwardly toward the head.

5 Claims, 4 Drawing Sheets

GOLF CLUB

This is a continuation of application Ser. No. 691,504 filed Jan. 14, 1985, now abandoned.

BACKGROUND OF THE INVENTION

This invention relates generally to golf clubs, and more particularly concerns improvements in heads having a bottom keel configuration.

When impact loads are transmitted to such metallic sole plates, the loads are typically transmitted to the wooden heads at points adjacent the plates. Where head laminations extend parallel to the plate, the load is transmitted to the few laminations adjacent the edges of the plate, and a tendency to destructive delamination can occur, particularly when a relatively immovable object such as a concealed rock is inadvertently struck. This problem is aggravated in that type of club disclosed in U.S. Pat. No. 3,761,095, wherein the sole plate carries a downwardly projecting keel which is more likely to strike objects concealed in the turf or ground. The attachment of such sole plates to the laminations as by screws is not an answer to the problem, since the edges of the threads form cracks in or between the laminations, encouraging delamination.

Also, the direct impact of a keel forward face with hard turf or ground surfaces during a golf swing tends to slow down the swing and result in less forward driving impact to the golf ball. This is true for golf irons as well as woods, and also for metal shell wood and iron leads.

SUMMARY OF THE INVENTION

It is a major object of the invention to provide an improved keel simple construction which will obviate the problems described above. Basically, the keel is constructed to have a forwardmost surface sloping upwardly and forwardly from the bottom of the keel, to intersect the head front face at a lateral linear location substantially above the bottom level of the keel, whereby the keel sloping surface on striking the ground during a golf swing will transfer some force upwardly toward the head, tending to compress the laminations.

Further, the head may also have auxiliary upwardly and forwardly sloped surfaces laterally of the uppermost extent of the keel sloped surface, and which auxiliary surfaces intersect the head front face along lateral lines which are lateral continuations of the linear intersection of the keel sloped surface with the front face, whereby extended "sledding" effect is achieved. Such effect is optimized when the line of intersection is between about 1/6 and ⅓ the height of the head as measured upwardly from the bottom of the keel and toward the uppermost extent of the front face; and when the keel sloping surface extends at an angle between 40° and 50° relative to the head bottom surface that lies horizontally, preventing delamination as referred to.

These as well as other objects and advantages of the invention, as well as the details of an illustrative embodiment, will be more fully understood from the following description and drawings, in which:

DRAWING DESCRIPTION

DETAILED DESCRIPTION

Figure 1:
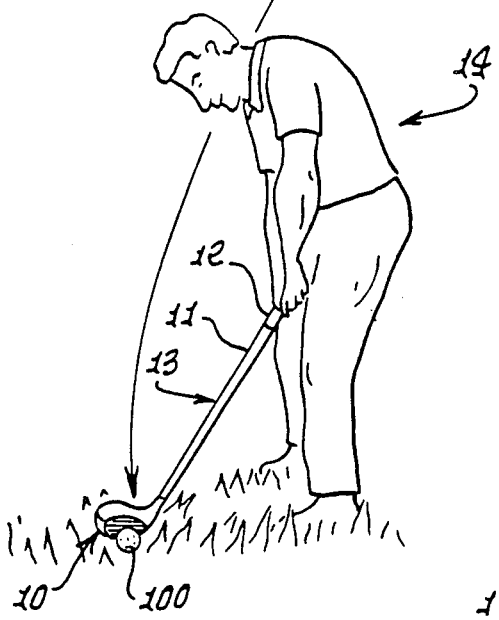
FIG. 1 is a front elevation showing use of a golf club incorporating the invention.
Figure 2:
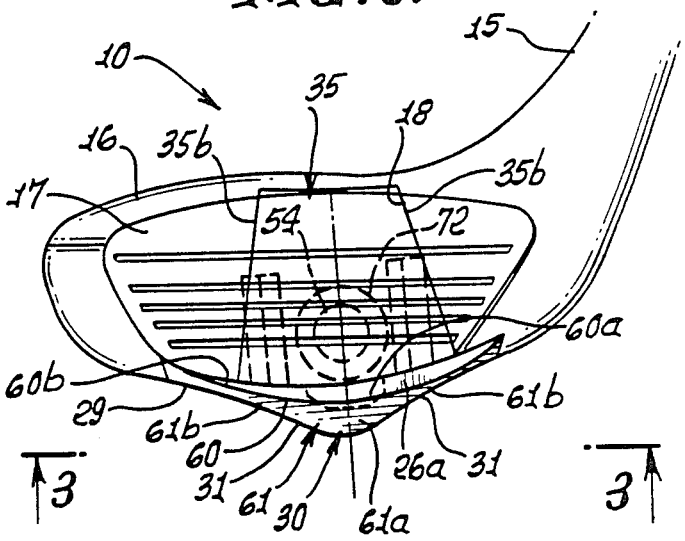
FIG. 2 is a frontal elevation showing a golf club "wood" head that incorporates the invention.

Referring now to the drawings and particularly to FIG. 1, a golf club head embodying the present invention is generally indicated at 10 and is shown secured to a shaft 11. The latter has a conventional grip 12 to form an improved golf club 13. The club 13 is shown in hands of a golfer 14, just as the head 10 is about to engage the ball. As best seen in FIG. 2, the golf club head 10 generally includes an upwardly extending shaft receiving hosel 15, a body 16, and a sole plate 25.

The golf club head 10 is shown as being a "wood", with the wooden body 16 having front face 17. The latter may be of any conventional incline to the vertical, as indicated by angle $\alpha$ in FIG. 4. The front face 17 has a centrally located cutout 18 for a trapezoidal panel 35. The body 16 is bulged (i.e. leftwardly convex in FIG. 6) at 19 behind the front face 17 as is conventional for a wood. The body 16 also has a lower surface 20 with a cutout 21 for receiving the sole plate 25. The cutout 21 follows the shape of the sole plate 25 to be fitted therein, and has centrally located, opposed peninsulas 22 to locate the sole plate 25 with respect to the body 16. The sole plate may consist, for example of cast metal such as zinc or zinc aluminum alloy.

Figure 3:
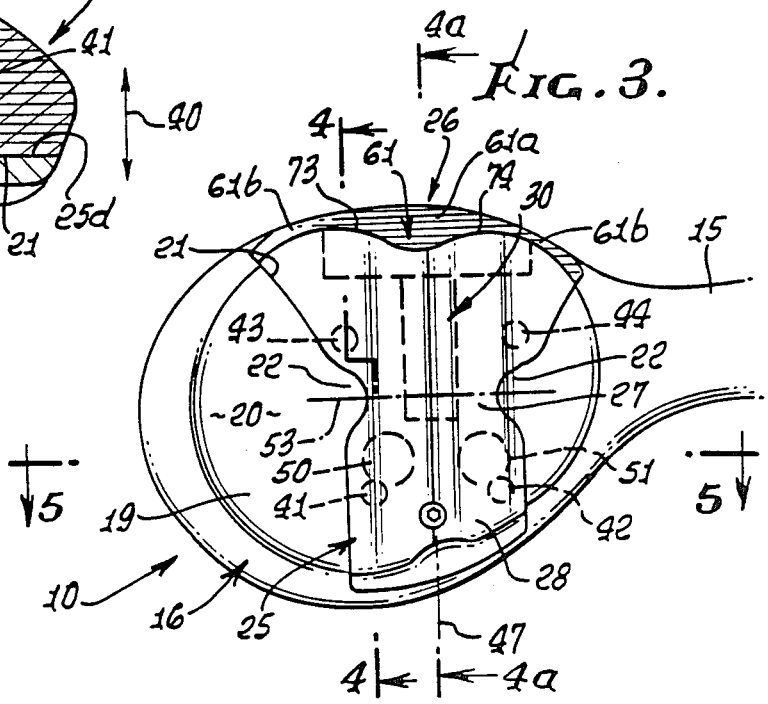
FIG. 3 is a bottom plan view on lines 3—3 of FIG. 2.
Figure 4A:
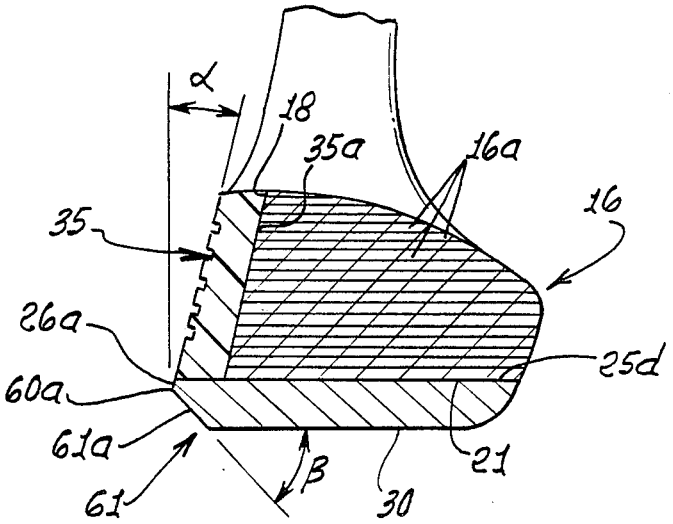
FIG. 4*a* is a section on lines 4*a*—4*a* of FIG. 3.
Figure 5:
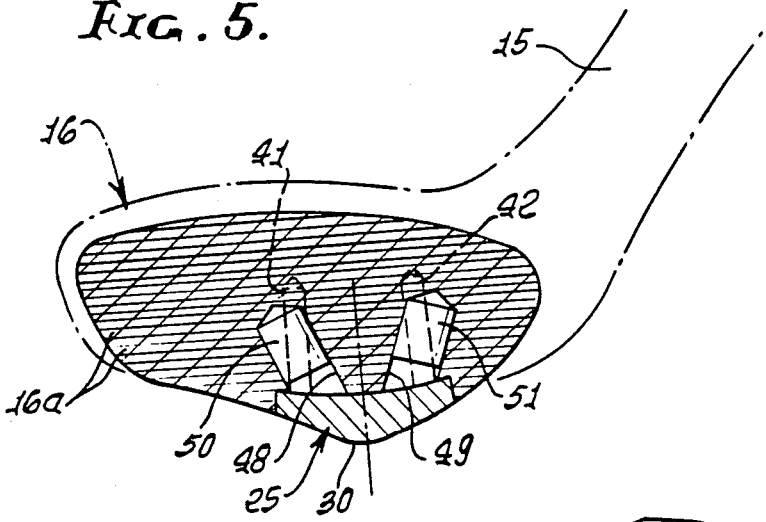
FIG. 5 is a section taken in elevation on lines 5—5 of FIG. 3.

As best seen in FIGS. 2 and 3, the sole plate 25 is shaped to mate with cutout 21 in the lower surface 20 of the body 16. The sole plate 25 has a shallow V-shaped front face 26 (as seen between lines 31 and 60, in FIG. 2) which, when the sole plate 25 is located in the cutout 21, provides an extension at **26*a* of the front face 17 of the body 16 above a line of intersection 60 of extension 26*a* with a rearwardly and downwardly sloping front surface 61. The front sloping front face 61 is relatively wide and the sole plate 25 extends rearwardly therefrom to narrow into a waist 27 before spreading again at the rear end portion 28. The waist 27 mates with the centrally located opposed body peninsulas 22 to locate the sole plate 25 with respect to the body 16. The sole plate 25 is secured within the cutout 21 in the lower surface 20 of the body 16 by a bonding agent such as epoxy to bond the sole plate 25 and the body 16** together.

As seen in FIG. 2, the sole plate 25 has a lower surface 29 from which a longitudinally rearwardly and forwardly elongated keel 30 protrudes downwardly. In FIG. 3, the longitudinal keel 30 extends generally centrally from the front face 26 and from sloping surface 61 rearwardly along a line corresponding to the path of swing of the front face of the golf club head 10. Note that rearward and downward (or upward and forward) sloping surface 61 has a middle portion 61*a* defined by the keel forwardmost extent, as well as side portions 61*b* which extend laterally beyond the keel forward surface 61*a*. The keel 30, being lowermost, typically contacts the ground before the ball 100 is struck to space the major portion 29 of the lower surface of the plate 25 and lower surface 20 of the body 16 from the ground. In particular the keel "sled" surface 61*a* may impact the ground at an angle to minimize resistance to forward travel of the head, and also to transfer impact force upwardly and rearwardly toward the head laminations, to minimize any tendency toward delamination, on impact. Also, surface portions 61*b*, being rearward and downwardly sloped, enhance these effects In the preferred embodiment, keel 30 has downwardly concave sides 31. (See FIG. 2). The concave sides 31 blend smoothly with the downwardly convex keel 30 and the major portion 29 of the lower surface of plate 25 and they merge with sloped surfaces 61*a* and 61*b*. They, and the sloped surfaces, tend to set up a favorable air flow over the lower surfaces 29 and 30 of the club head 10 as the club 13 is swung through the air; further, as the head 10 passes through the air, the keel 30 splits the air ahead of the club head 10 and the concave sides 31 direct the air outwardly as it passes over the lower surfaces 29 and 20. This pattern of air flow tends to separate and bend the grass as the head 10 approaches the ball (see FIG. 1) rather than crush the grass as the conventional flat bottomed head does.

The golf club head 10 is completed by the insertion of the trapezoidal panel 35 in the cutout 18 on the front face 17 of the body 16. The panel 35 typically consists of a hard plastic material which can engage a ball repeatedly without becoming dented or worn as the wood of the body 16 would otherwise become if such a panel 35 were not provided. A suitable bonding agent such as an epoxide may be employed to bond the rear wall 35*a*, sides 35*b* and bottom 35*c* of the insert to corresponding surfaces of the body and of the sole plate 25.

Figure 4:
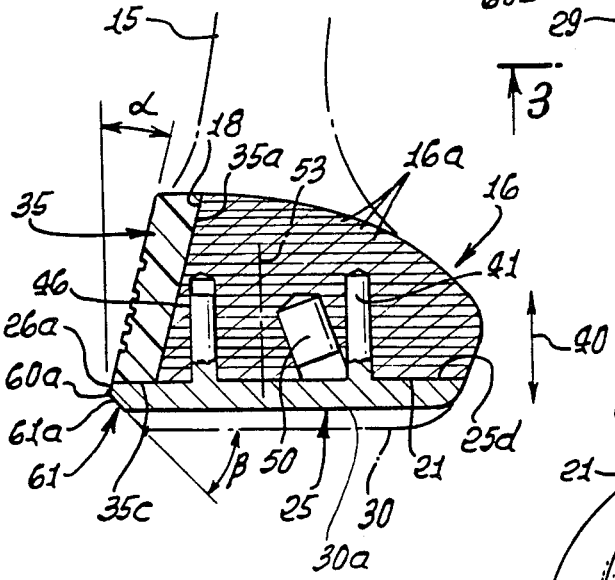
FIG. 4 is an elevation taken in section on lines 4—4 of FIG. 3.

As shown in FIG. 4, the body 16 is typically defined by a vertical stack of generally horizontal and parallel laminations 16*a* consisting of wooden sheets bonded together at their interfaces. As an example, there may be between 17 and 19 such laminations per inch in the direction of arrows 40 in FIG. 4. The strength of the club head, to resist impact of the ball, is thereby enhanced. However, the rather shallow thickness of the sole plate, in the direction of arrows 40, causes stress concentration at the lowermost laminations 16*a*, i.e. those below the level of the upper surface 25*d* of the plate 25, since at times the full impact load of the club head against a concealed rock or other object is transmitted from the sole plate to such lowermost laminations.

The sole plate typically carries or defines at least one stud and preferably multiple studs, or holders, integral with the plate and projecting upwardly from the plate upper side 25*d* into a corresponding opening or openings extending upwardly in the head from the cutout or recess 21. As shown in the drawings, multiple studs or holders 41–44 are shown projecting within and closely fitting corresponding drilled openings 41*a*–44*b* with vertical dimensions exceeding the combined thicknesses of at least two of the laminations through which the studs project. For best results, the studs project through at least about 10 laminations. Adhesive bonding material such as epoxide resin is employed as at 46 between the studs and the walls of the openings receiving them, to rigidly bond the studs to the laminations, whereby loading is transmitted to multiple laminations above the recess or cutout 21 in response to heavy impact loading. Such loading is; however, directed upwardly and rearwardly by sloping surfaces 61*a* and 61*b*, and toward the laminations, to "compact" them rather than pull them apart. Destructive delamination is thereby avoided since the load is sufficiently distributed and directed toward the laminations as to avoid it.

FIG. 3 shows that studs 41 and 43 are located at one side of a vertical plane 47 which bisects the keel 30, and studs 42 and 44 at the opposite side of the plane. Plane 47 extends forwardly and rearwardly and through the crest of the keel. Also, studs 43 and 44 are located forwardly of the peninsulas 22, and studs 41 and 42 rearwardly of the latter. Such spacing distributes the load over the club head, in balanced relation relative to the head and the sole plate. Plate side pockets 22*a* receive such peninsulas.

Figure 6:
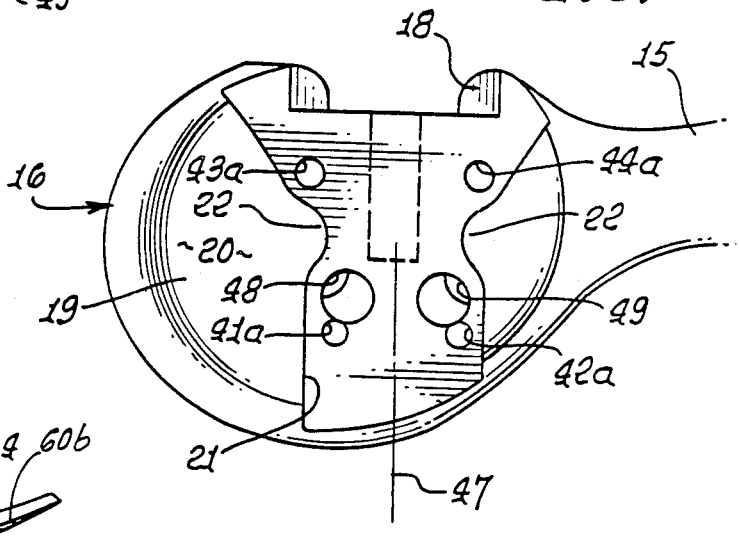
FIG. 6 is a bottom plan view like FIG. 3, but with the insert plate removed.

FIG. 6 illustrates the provision of two additional openings 48 and 49 projecting in the body 16 upwardly and forwardly, as well as laterally away from plane 47, at angles from vertical, and at opposite sides of the plane 47. Such openings intersect the bottom surface of recess or cutout 21, and are of larger diameter than the equal diameters of the studs, the latter being about ⅛ inch, for example. Concealed weights 50 and 51 are or may be fitted in the recesses, which are typically located rearwardly of a lateral upright plane 53 bisecting the peninsulas 22, as is clear from FIGS. 3 and 4. The weights are typically bonded in position, in their associated openings. FIGS. 2 and 3 show the outline 54 of an additional cylindrical opening to receive weighting material, and which extends rearwardly into the body 16 above the keel and from a position intersecting the cutout 18. Plane 47 bisects opening 54.

Figure 8:
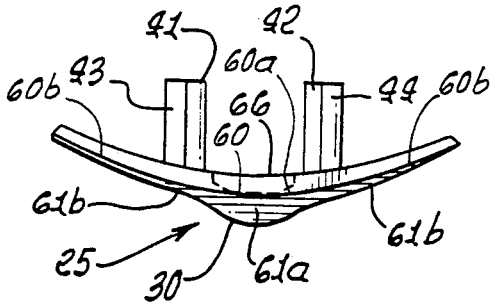
FIG. 8 is an end elevation on lines 8—8 of FIG. 7.
Figure 9:
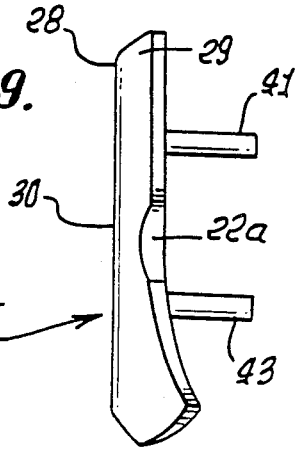
FIG. 9 is a side elevation on lines 9—9 of FIG. 7.
Figure 7:
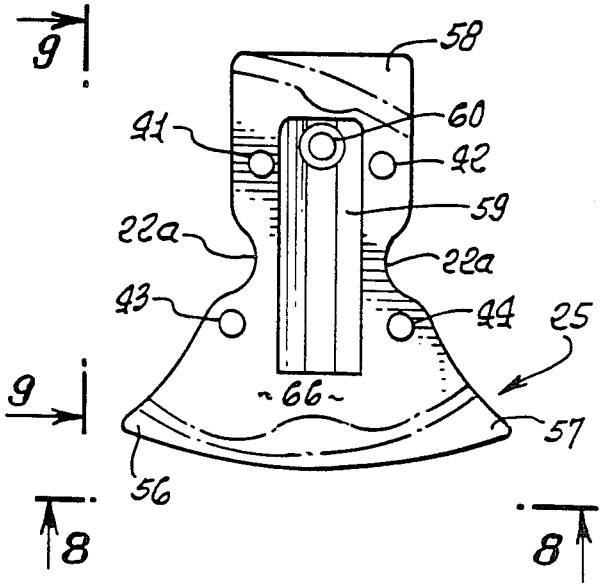
FIG. 7 is a bottom plan view of the insert plate in as molded condition, i.e. before trimming.

FIGS. 7–9 show the sole plate in as-cast condition, with ears 56 and 57 which are later partially cut-away or trimmed to match the contour of the wooden body 16, during assembly. Also, plate portion 58 is trimmed during such assembly. A central, elongated recess 59 is formed, for casting purposes, as via a duct 60 in that recess. The recess intersects the concave upper surface 66 of the sole-plate, as shown. The symmetric construction is such that the FIGS. 7–9 sole plate may be used on either left or right handed club heads.

The studs 41–44 are smooth surfaced, as are their receiving openings 41*a*–44*a*, to prevent formation of cracks in or between the laminations, which would encourage delamination.

Openings 48 and 49 are located rearwardly of a lateral upright plane through the peninsulas 22, but forwardly of openings 43*a* and 44*a*, so as not to interface with the latter.

It will be noted that the sloped auxiliary surfaces 61*b* intersect the head front face along lines 60*b* which are lateral continuations of the linear intersection 60*a* of the keel sloped surface 61 with the front face 17. That line of intersection extends laterally along at least about half the head front face lateral dimension, and it is located between about ⅛ and ¼ the height of the head as measured upwardly from the bottom of the keel and toward the uppermost extent of the front face. Further, keel sloping surface 61 extends at an angle $\beta$ between about 40° and 50° relative to the head bottom surface, as at 30*a* in FIG. 4 that lies horizontally. Note also that sloped surface 61 is below the sweet spot, generally indicated at 72, in FIG. 2, i.e. the preferred and centered ball striking surface, generally circular.

The keel concave opposite sides 31 intersect the auxiliary sloping surfaces **61*b* along lines of intersection 73 and 74. Surfaces 61*b* curve laterally, rearwardly and upwardly away from 61*a*, while also sloping downwardly and rearwardly toward lines 73 and 74. Lines 73 and 74 define a rearwardly convex bulge at the bottom of the keel in FIG. 3, whereby the sloping surface 61*a* has greater height than the height dimension of sloping surfaces 61*b***. Accordingly, force of impact with the ground is transmitted upwardly and rearwardly, toward the laminations, tending to compact them, not "delaminate" them as by shear. Also, such sloping assists forward travel of the head despite keel impact with the turf or ground.

Figure 10:
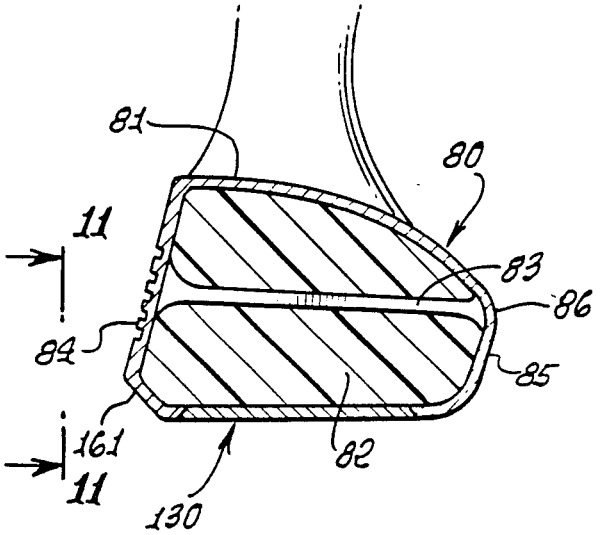
FIG. 10 is a view like FIG. 4, but showing a metal "wood" head incorporating the invention.
Figure 11:
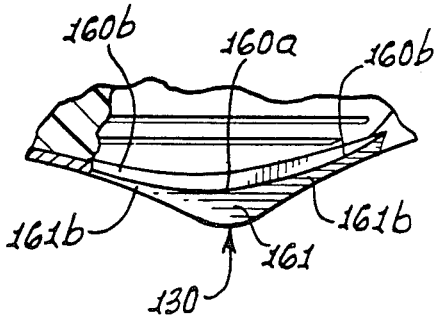
FIG. 11 is a fragmentary section taken on lines 11—11 of FIG. 10.

FIGS. 10 and 11 show application of the invention to a "metal wood" head 80, comprising a thin metal (such as steel) shell 81, having a central hollow which may be filled with plastic material, as at 82. A reinforcement strut 83 may be located to extend integrally from the rear of front wall 84 to the rear wall 85, at corner 86. The keel 130 corresponds in shape with keel 30, and sloping front surface 161 as well as sloping auxiliary surfaces **161*b* correspond to above described sloping surfaces 61 and 61*b*. See also line of intersections 160*a* and 160*b* corresponding to line 60*a* and 60*b***.

Figure 12:
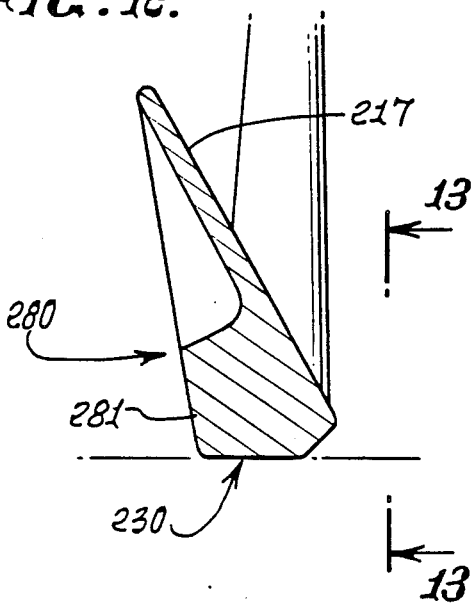
FIG. 12 is a section taken through an "iron" head, incorporating the invention.
Figure 13:
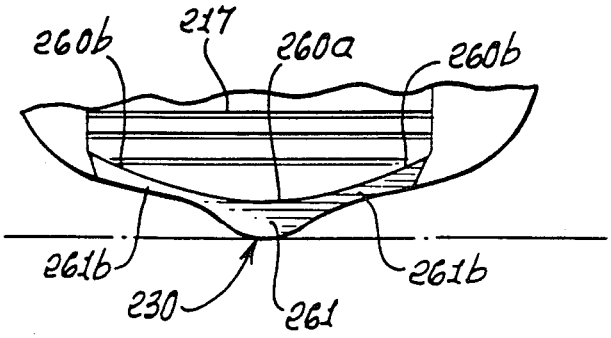
FIG. 13 is a fragmentary section on lines 13—13 of FIG. 12.

FIGS. 12 and 13 show the invention extended to a golfing iron 280, having head 281 with front face 217, keel 230, keel front wall 261 that slopes downwardly and rearwardly from line of intersection **260*a* with front face 261; and auxiliary sloping surfaces 261*b* (corresponding to surfaces 61*b*) at laterally opposite sides of surface 261 and forming continuations of surface 261. The line 260*a* has lateral continuations at 260*b*, like continuations 60*b***.

I claim:

1. A golf club head (10) having a front face 5, bottom and top surfaces, a toe and heel, the face of the club extending directionally laterally between toe and heel, the head having a stack of horizontally extending laminations, and an elongated protuberance extending rearwardly and forwardly below said laminations and along the bottom of the head and centrally thereof to define a keel (30), the keel having a lowermost surface a substantial portion of which is straight, in a front to rear direction, the improvement comprising:

(a) the keel having a forwardmost surface (**61*a*) sloping upwardly and forwardly from the bottom thereof and intersecting the front face (17) to define a line of intersection (60*a*) substantially above the bottom level of the keel, whereby said forwardmost sloping surface (61*a*) on striking the ground during a golf swing wall transfer some force upwardly toward the head laminations tending to compress same and prevent delamination, (b) said head also having auxiliary upwardly and forwardly sloped surfaces (61*b*) laterally of and merging with the uppermost extent of said forwardmost sloped surface, and which auxiliary surfaces intersect the head front face along lateral lines (60*b*) which are lateral continuations of the line of intersection (60*a*) of said forwardmost sloped surface with said front face, (c) said forwardmost sloping surface (61*a*) of th e keel extending at an angle between 40° and 50° relative to said straight surface portion of the keel, the surface of said head between said lateral lines of intersection (60*b*) at the front face and (73,74) at the underside of the keel vertically therebelow defining an angle between 40° and 50° relative to said straight surface portion of the keel, (d) the forwardmost sloping suface (61*a*) intersecting the bottom of the keel at said straight surface portion thereof and being substantially greater in height than the heights of said auxiliary surfaces (61*b*), the bottom of the keel being at the lowest level of the entire head, (e) said keel having opposite sides (31) which slope upwardly and laterally, rearwardly of said forwardly and upwardly sloping front surface, said opposite sides being downwardly concave, (f) said lateral lines of intersection (60*b***) being spaced above the level of the merging of said keel opposite sides with the head bottom surface, and above the levels of said concave sides.

2. The improvement of claim 1 wherein the protuberance is defined by a metal plate attached to a wooden body defined by the head.

3. The improvement of claim 2 wherein the entirety of said forwardmost sloping surface is located below a plane defined by the upper surface of said plate extending beneath the bulk of the wooden body.

4. The improvement of claim 1 wherein said line of intersection is located between about $\frac{1}{8}$ and $\frac{1}{4}$ the height of the head as measured upwardly from the bottom of the keel and toward the uppermost extent of said front face.

5. The improvement of claim 1 wherein said protuberance is located below a lower center portion of said front face.

* * * * *